United States Patent [19]

Priebe

[11] Patent Number: 4,848,258

[45] Date of Patent: Jul. 18, 1989

[54] AIRFOIL SAILING SYSTEM

[76] Inventor: Paul D. Priebe, 922-10th Ave. East, Seattle, Wash. 98102

[21] Appl. No.: 855,498

[22] Filed: Apr. 23, 1986

[51] Int. Cl.[4] ..... B63H 9/06

[52] U.S. Cl. ..... 114/103; 114/90; 114/102; 244/217

[58] Field of Search ..... 114/39, 89, 90, 97, 114/98, 102, 103; 244/213, 217, 216, 123

[56] References Cited

U.S. PATENT DOCUMENTS

| | | | |
|---|---|---|---|
| 689,648 | 12/1901 | Lowry | 114/103 |
| 3,968,765 | 7/1976 | Menegus | 114/102 |
| 4,116,151 | 9/1978 | Guthrie | 114/102 |
| 4,263,861 | 4/1981 | Vicard | 114/103 |
| 4,280,428 | 7/1981 | Werner | 114/102 |
| 4,402,277 | 9/1983 | Wainwright | 114/103 |
| 4,453,483 | 6/1984 | Shallenberger | 114/102 |
| 4,465,008 | 8/1984 | Liggett | 114/103 |

FOREIGN PATENT DOCUMENTS

| | | | |
|---|---|---|---|
| 57-158192 | 9/1982 | Japan | 114/103 |

*Primary Examiner*—Joseph F. Peters, Jr.
*Assistant Examiner*—Clifford T. Bartz
*Attorney, Agent, or Firm*—Don R. Mollick

[57] ABSTRACT

An airfoil system for use on water vessels is described. A plurality of fore and aft symmetrical sails are arranged to form an asymmetrical two surface airfoil. The individual sails may be rotated to allow tacking. The parameters of sail configurations described form a high lift low drag airfoil. Two and three sail configurations are described.

6 Claims, 5 Drawing Sheets

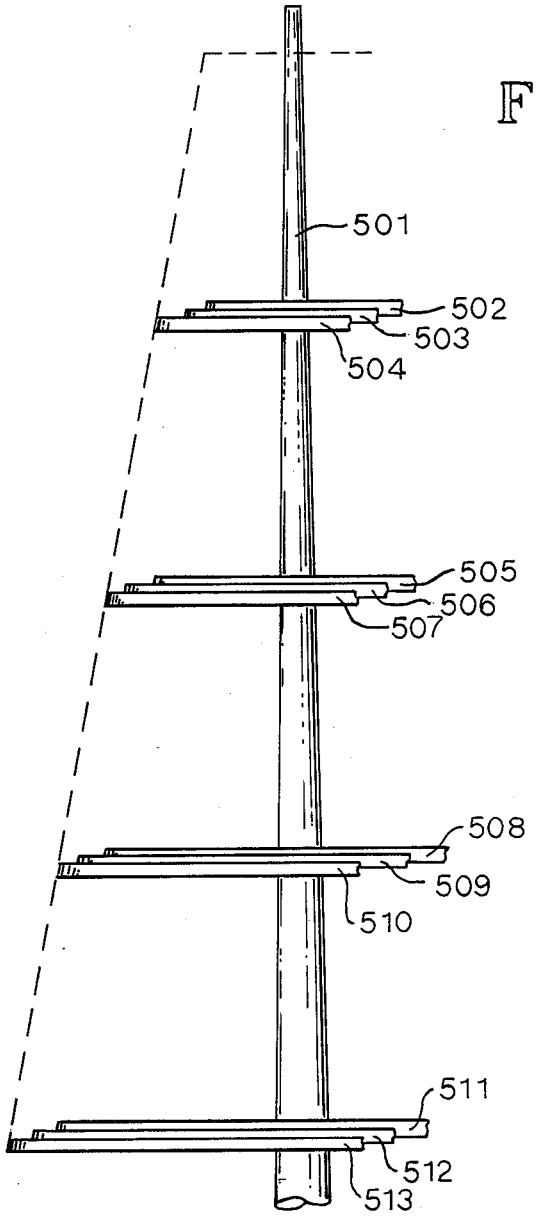
FIG. 5
FIG. 6
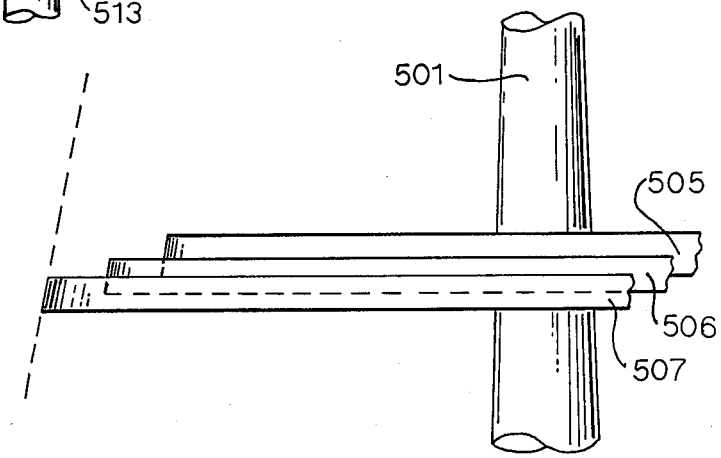

AIRFOIL SAILING SYSTEM

FIELD OF THE INVENTION

This invention relates to methods of propelling water craft by wind power, in particular, to propelling water craft by means of airfoil sails, and with still greater particularity, to systems of airfoil sails that are adaptable to all sizes of craft while providing high lift characteristics.

DESCRIPTION OF PRIOR ART

The use of wind power to propel water craft is as old as recorded history and many designs of sails have been developed. The traditional sail is one or more pieces of fabric supported by masts and rigging to catch a portion of the wind. The primary advantages of the traditional sail are low cost and long standing experience with such systems. The primary disadvantage of the traditional sail is that it is basically an inefficient use of the wind power that is potentially available. The increasing cost of fuel and doubts about fuel's continued availability have led to an increase in interest of efficient sails for propelling all types of craft. None the less, the traditional sail is still the most frequently considered design.

The development of aeronautics in the twentieth century has led to the scientific study of moving air on plane and three dimensional surfaces. These studies have resulted in the development of airfoil sails. The airfoil sail differs from the conventional sail by having two surfaces of differing curvature. Air moves past both surfaces, but is forced to complete a longer path around the surface having the greater curvature. The air in the vicinity of the more curved surface is thus sped up resulting in a loss of pressure. The situation is thus identical to that seen in an airplane's wing where the pressure differential is called lift. Only by use of two surface sails can high lift be obtained. This results in more efficient utilization of the wind's energy than traditional sails.

Numerous airfoil sails have been developed, but none have found wide spread acceptance in spite of their theoretical advantages. While some of this lack of acceptance can be placed on the naturally conservative nature of sailors, the present airfoil sails present several disadvantages. First, the use of two surfaces and the means necessary to support them, results in a higher cost than that of traditional sails. Unless this higher cost can be offset by increased performance, the sail will be uneconomical. Second, the increased amount of gear required increases the weight of the craft and can diminish the expected increase in efficiency. Finally, the present airfoil systems pose problems in tacking and none seem to have arrived at a completely satisfactory solution. For the above reasons, no airfoil sail system has received widespread acceptance.

Tacking is the sailing maneuver used when a sailing craft is desired to change its direction relative to the wind, propelling it. The craft sails at an angle into the wind, then turns so that it is sailing into the wind at the same angle, but on the opposite side relative to the wind. The craft by repeated tacks thus describes a zigzag path into the wind. In traditional sailing craft, the turn is accomplished by turning the rudder and allowing the sail to reverse. No problem is posed in conventional craft, as the sail is flexible, and can reverse. In airfoil sail designs, however, this is not possible as the sail is composed of two surfaces of different lengths.

Attempted solutions to this problem have included use of a set of mirror image sails that are raised at the opportune moment, or flipping the sail over the mast when direction is reversed. These solutions add to the weight and expense, and are generally impractical for larger craft, or those with more than one sail. Alternately, airfoil sails have been designed with surfaces that are symmetrical from side to side and are distorted by the wind to an approximation of the desired shape. Such designs can solve the tacking problem, but only at the expense of efficiency, which is their primary justification.

In summary, what is described in the following is a sail system that is adaptable to all sizes of craft and which is capable of easily tacking. This system should produce high efficiency at a minimization of expense and weight and therefore be commercially feasible.

SUMMARY OF THE INVENTION

The invention is a sailing system which is usable with any size of sailing craft, and with multiple sails. The invention is comparable in cost and weight to traditional sails and is much less complex. The invention uses the most recent developments in aerodynamic technology to produce an airfoil sail system having high lift and efficiency. The design of the invention allows the craft to run more directly into the wind than previous designs, and to tack with minimum effort.

The invention is comprised of at least one mast to which a plurality of yards are attached. The yards may slide upon the mast to enable the sails to be fully, or partially furled. The yards are in the shape of an airfoil that is symmetrical from front to back, but asymmetrical from side to side. Fabric is attached to the periphery of the yards, and forms the surface of the sail. The mast is enclosed in the sail. No external rigging, other than guys to steady the mast, is used. The mast is rotatable to sail at different angles to the wind and to allow tacking.

For greater efficiency, or lift, additional masts are added. The first, a mizzen mast, is mounted aft of the main mast. The mizzen mast has yards similar to those of the main mast and provides a similar sail. This sail is mounted in proximity and position by the main sail in such a manner as to provide an extra high lift surface that is analogous to a lift increasing flap on an aircraft wing. Similarly, a jib can be added forward of the main mast to form a complete analogy to an aircraft wing, having both slotted leading edge and flap, which act together. A small gap or slot between the surfaces is used to allow the air to flow from the high pressure to the low pressure side of the sail system, thereby preventing stall. The jib and mizzen masts may be attached to the main mast by booms at either end, and are also rotatable. A cover surface may be provided at the upper end of the masts to minimize loss due to air flow over the sail tip.

The craft, equipped with the invention, sails in a manner similar to that of a conventional sailing boat, except that it is generally capable of heading more directly into the wind than one with equivalent conventional sails, due to the high lift and low drag characteristics of the sails. The sails may be adapted to run directly with the wind by rotating the masts and arms in to an appropriate position. To tack, the craft is headed into and through the wind in the manner of a conventional sail boat. As the tack is completed, each mast is rotated approximately one-half turn. The individual sails are symmetrical fore and aft so that the optimum configuration is maintained. The word sail is used to denote both the entire body covered by sailcloth and also the sailcloth covering itself.

BRIEF DESCRIPTION OF THE DRAWINGS

FIG. 5 is a front elevation view of a reefed sail assembly used in the invention.

FIG. 6 is a front elevation view of a single panel of FIG. 6.

DESCRIPTION OF THE PREFERRED EMBODIMENT

Figure 1:
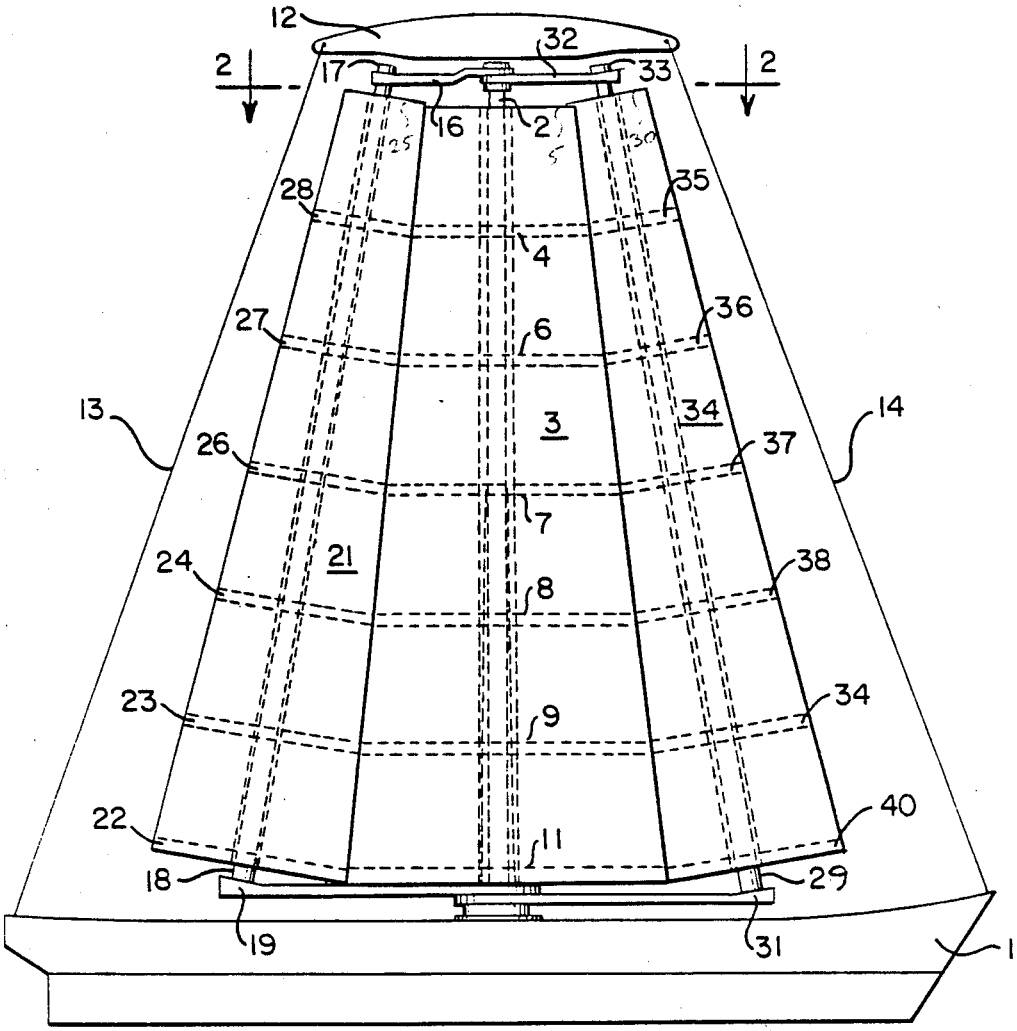
FIG. 1 is a side elevation view of the invention attached to a ship.

FIG. 1 is a side elevation view of one embodiment of the invention attached to a ship.

The hull 1 of the ship shown, is a profile of a conventional cargo vessel. This hull is an example of an efficient sailing hull, but it is realized that the sail system may be used with other hulls, including modern oil tankers.

A main mast 2 is attached to hull 1, roughly at mid ship. Main mast 2 is attached in such a manner as to allow rotation. In small ships, such rotation could be manual, but, in larger vessels, mechanical means would be used to rotate mast 2. Mast 2 carries a main sail 3. Sail 3 is a two surface sail, having a first curved, and a second curved surface of a lower curvature. Sail 3, thus, somewhat resembles an airplane wing. A series of yards 4, 5, 6, 7, 8, 9 and 11 attach main sail 3 to main mast 2. The yards are in the shape of the desired sail profile, and are provided with a hole for passage of main mast 2. The yards may be provided with means to allow vertical movement on mast 2 to allow furling of sail 3. On top of mast 2 may be mounted a cover surface 12. Cover surface 12 does not rotate with mast 2, and is stabilized by guys 13 and 14. In this embodiment, cover surface 12 is substantially diskoid to present a streamlined surface to the air.

A second, or mizzen mast 18, is shown aft of the main mast. Mizzen mast 18 is rotatably mounted to a lower boom 19 and an upper boom 16. Means are provided to rotate mizzen mast 18 over 360°. Booms 16 and 19 are in turn rotatably mounted to main mast 2, and means are provided to allow rotation of booms 16 and 19. Cover surface 12 is provided with an indentation to allow clearance of the top end 17 of mizzen mast 18. The mizzen sail 21 is attached to mizzen mast 18 by yards 22, 23, 24, 25, 26, 27 and 28 in a similar manner to the mounting of main sail 3 to main mast 2. In a similar manner, the yards may be lowered on mizzen mast 18 to furl the sails. If a two-sail configuration is desired, only these two masts are used.

Figure 2:
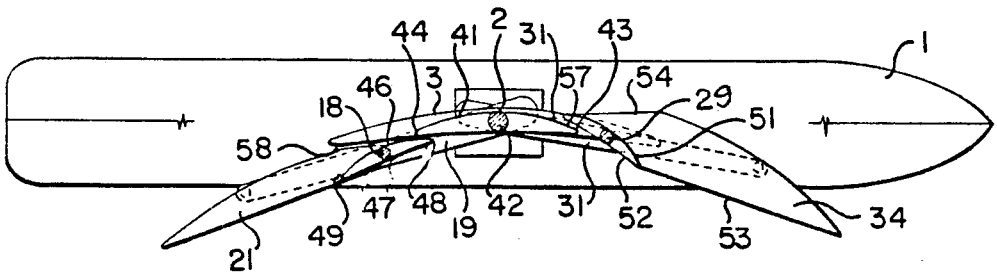
FIG. 2 is a section plan view of the FIG. 1 embodiment.

For most applications, it is desirable to add a third or jib mast 29 ahead of main mast 2. This configuration can result in higher efficiency than the two-sail configuration. Jib mast 29 is rotatably mounted to an upper boom 32 and a lower boom 31. Booms 31 and 32 are in turn rotatably mounted to main mast 2 in a manner similar to the mounting of mizzen mast 18. Similarly, a jib sail 34 is mounted to jib mast 2 by a series of yards 30, 35, 36, 37, 38, 39 and 40, and cover surface 12 is supplied with an indentation to allow passage of the top 33 of jib mast 29. It is realized that the number of yards and size of sails may vary for different-sized vessels. Similarly, the sails need not be tapered. FIG. 2 is a plan section view of the FIG. 1 embodiment. Cover surface 12 is not shown for clarity (nor are upper booms 16 and 32).

It should be noted that the upper surface of mizzen sail 21 and jib sail 34 is viewed at an angle, and therefore, somewhat distorted. Mizzen sail 21 and jib sail 34 are symmetrical fore and aft in the manner of main sail 3. The sails are shown in a fore and aft configuration. It is realized that in actual sailing conditions, the sails are at an angle to the centerline of hull 1.

Main sail 3 is seen in profile to have two main surfaces. The first surface 41 has a positive curvature. The second surface 42 is shown with a negative curvature, but it is realized that surface 42 could be flat, or even have a smaller positive curvature than surface 41. The result of the curvatures of surfaces 41 and 42, is that sail 3 comes to two edges 43 and 44; edges 43 and 44 are rounded and equal-distant from the center of mast 2. This is a different situation than that found in airfoils, such as aircraft wings, in which the distance from the thickest portion to the leading edge is generally less than that to the trailing edge. In the invention, leading and trailing edges can alternate so each sail must have an axis of symmetry. In a similar manner, mizzen sail 21 has a first curved surface 46 and a less curved surface 47 which join to form rounded edges 48 and 49. Finally, jib sail 34 also has a first curved surface 51 and a second less curved surface 52, and two edges 53 and 54.

While each sail is symmetrical airfoil, the sails together form a high lift asymmetrical airfoil. A slot 56 is formed between the first surface 46 of mizzen sail 21 and the second surface 42 of main sail 3 due to the overlap of edges 44 and 48. Similarly, a second slot 57 is formed between the first surface 41 of main sail 3 and the second surface 52 of jib sail 34 by the overlap of edges 43 and 54. The result is collection of sails which act as a single large high lift, low drag airfoil, with surfaces 46, 41 and 51 acting as the upper combined surface, and surfaces 47, 42 and 52 acting as the lower surface. Slots 56 and 57 bleed a portion of air from the lower to upper surface to prevent the system from stalling while at high angles to the wind. The combination described provides a high lift combined with low drag.

In operation the masts are not normally in the FIG. 2 position. In a typical application, the vessel could be heading into the wind at an angle. The main sail 3 is set at an angle to the relative (apparent) wind to provide lift, typically, 10°–20°. The jib 34 is set at an angle to the main sail, say 15°–25°, and the mizzen at an angle to the main sail, typically 15°–25°. Booms 16 and 19 are set so that slot 56 is of a predetermined size. Similarly, booms 31 and 32 are set to determine the size of slot 57. On this tack, the leading edge of the sail assembly is edge 53 of the jib and the trailing edge 48 of the mizzen. The air flowing over the assembly will form an area of low pressure forward (above) the sail assembly and a high pressure area aft (below) which will propel the vessel forward.

To switch the vessel to the opposite tack, first the rudder is turned to change the direction of the vessel. Next, each mast is rotated clockwise, and each boom moved across the vessel centerline to reform the sail assembly with each sail in the same relative position, but on the opposite side of the vessel.

Figure 2A:
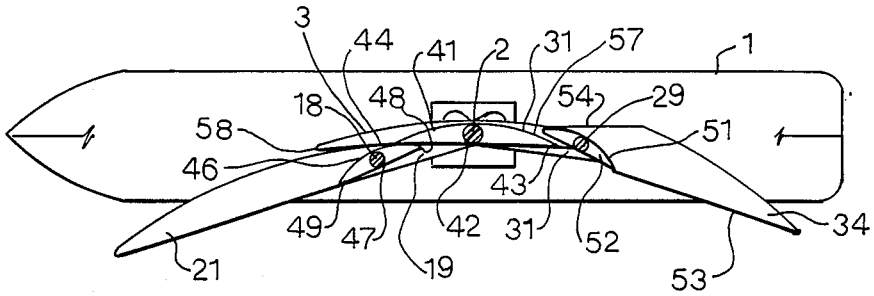
FIG. 2*a* is the FIG. 2 after tacking.

Tacking is provided for by rotating the first sail element 41 around the mast 2 and rotating the second sail element 34 around the second mast 29 and by rotating the boom 31 around first mast 2 over the centerline 45 of the craft 1 moving element 41 and element 34 to angles equal to but opposite the angles elements 41 and 34 and boom 31 were to the centerline 45 of craft 1 before tacking. FIG. 2*a* illustrates the sails after the above operations are made. Edge 54 of the jib is now the leading edge and edge 48 of the mizzen, the trailing edge. The air is thus moving over each individual surface in a direction opposite to that on the opposite tack as each sail has turned about one-half revolution. Since each individual sail is symmetrical about its mast, each sail is equally efficient on each tack. Finally, since the sail assembly is in exactly the same asymmetric configuration, only opposite, there is no diminishment of efficiency.

As a final alternative this system can be used if it is desired to run before the wind or scud. To accomplish this maneuver, mast 2 is rotated clockwise, so that main sail 3 is 90° from its FIG. 2 position. Booms 31, 19 16 and 32 are rotated so that they are approximately normal to the centerline of hull 1, and jib 34 and mizzen 21 are rotated to be continuous with main seal 3. The result is the formation of a single large sail to catch the wind analogous to a spinaker.

Figure 3:
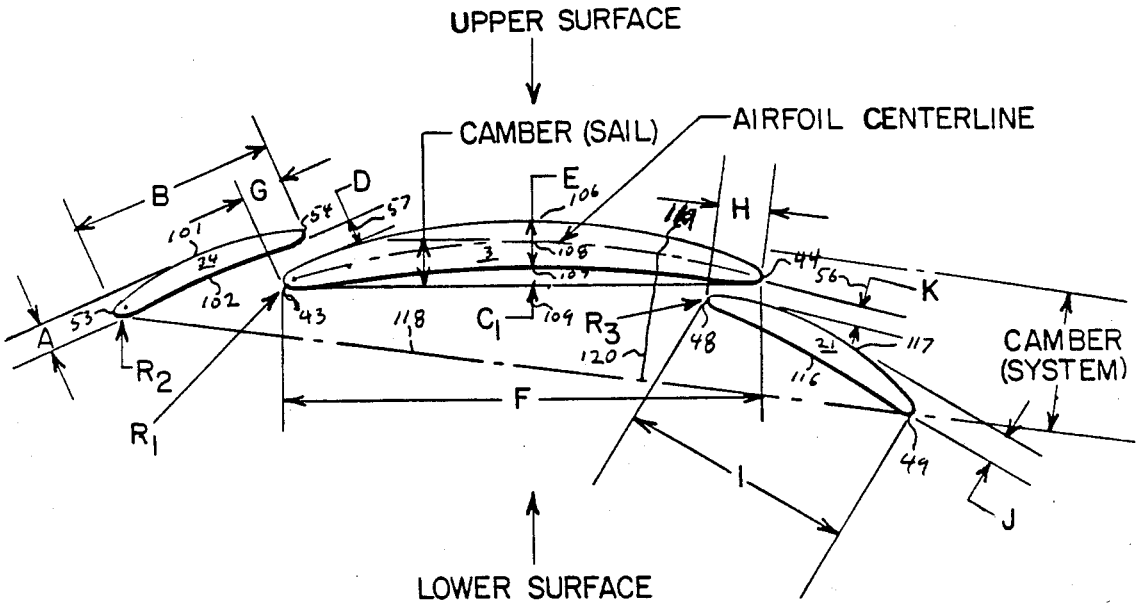
FIG. 3 is a sectional view of the FIG. 1 sail, rotated end for end.

FIG. 3, rotated end for end from FIGS. 1 and 2, is a section view of the sail system in a typical configuration. Point 101 on one surface of jib 34 and point 102 on the opposite surface define the thickness of the jib. The sail is effective if this distance is between 2–15% of the distance between edge 53 and edge 54. Satisfactory performance may be obtained when the distance between 101 and 102 is 8 to 12% of the distance between 53 and 54, but other configurations can be used for special purposes. The radius of the edges 53 and 54 may be from 0–5% of the distance between 53 and 54, though other than circular arcs may form all sail edges.

On main sail 3 the thickest point is between points 106 and 107, at mid-chord where mast 2 would lie. The sail chord is the distance between edges 43 and 44. Line 109 is the tangent to the two equal radii forming edges 43 and 44. The camber of the sail is the distance between line 109 and point 108 midway between 106 and 107 divided by the distance between 43 and 44. Main sail 3 is effective if the distance between 106 and 107 is between about 3 and 20% of the distance between edges 43 and 44 and preferably between 8 to 12%. The radius of edges 43 and 44 may be from 0–10% of the distance between 43 and 44, but preferably 1–2%. The camber of sail 21 may be between 0.02 and 0.15 to be effective, but is preferably between 0.04 and 0.06. The distances between 107 and 109 which defines the curvature of the lower surface of main sail is effective if between 0 and 5% of the distance between 43 and 44, but preferably, 1–3%.

The proportions that apply to the mizzen apply equally to the jib, but, it is noted that the jib need not be identical to the mizzen. While FIG. 3 shows the analogous distance to that between 107 and 109 to be nearly 0 for the jib and mizzen, such distance may be between 0 and 10% of the distance between 43 and 54, or 48 and 49, respectively. The distance between 53 and 54 may be between 10 and 250% of the distance between 43 and 44, but is preferably between 25 and 65%. This relation also holds for the mizzen 21.

The dimensions of slots 56 and 57 can have a bearing on sail performance in this embodiment of the invention.

The gap is measured as a per cent of the distance between points 43 and 44. A sail is operable if the gap is between 0 and 50% of the distance between 43 and 44, but best performance may be obtained between 2 and 5%. This reaction holds for both gaps 56 and 57. The length of the slot is determined by the degree of overlap between the jib or mizzen and the main sail, i.e, approximately the chordwise distance between 54 and 43, or 48 and 44. The length of the slot should be between 5 and 45% of the distance between points 43 and 44, and is preferably 5 to 8%. Slot proportions for jib may differ from those of mizzen.

The total system camber is the distance 120 between the system chord 118, which is approximately the line between points 53 and 49, and the most distant point 119 along the center of main sail 3. The sail is operable, if distance 120 divided by the length of system chord 118 is between 0.05 and 0.25, but the desired range is between 0.1 and 0.15.

All of the above dimensional proportions are mutually interdependent and are only preliminary guides to design. In individual cases, all preferred dimensions should be fixed by wind tunnel testing and/or equivalent analysis.

The sail system may be tapered as shown in FIG. 1. The same relationships described in FIG. 3 apply. For smaller vessels, the sails need not be tapered, and no provision for furling is mandatory. Cover surface 12 in FIG. 1 serves to prevent air from spilling over the sail tip and reducing lift. While booms are used for supporting the mizzen and jib, it is understood that tracks or equivalent could be used.

Surface materials associated with FIG. 1 are conceived as sailcloth, or similar material, which is therefore adaptable to reefing as described. However, sail elements may be covered with any other material consistant with reefing needs. Solid or stiff surfaces, such as sheet metal, plywood, or plastic cover, may be used, making all or any chosen combination fixed, and not appropriate to reefing or folding. Further, individual sail elements may be covered with such stiff or rigid material in segments, allowing for a collapsible or effectively telescoping capability on any chosen sail element. Thus, the system may incorporate any desired combination of fixed and collapsible or reefable, partial or full sail elements, which is appropriate to the type and size, and type of ship or boat.

Figure 4:
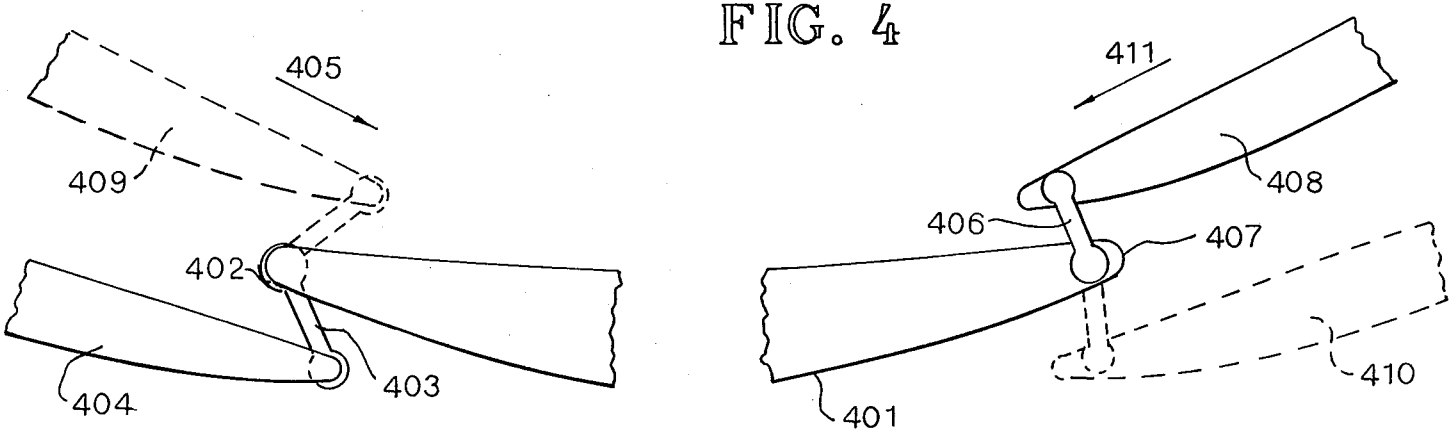
FIG. 4 is a sectional view of a second embodiment of the FIG. 1 sail.

FIG. 4 is a plan section view of a second embodiment of the invention. In this invention the main sail 401 is similar to the FIG. 3 embodiment. At one edge 402 of mainsail 401 is a rotatably mounted link 403. One end of link 403 is rotatably mounted to mainsail 401 and the other end is rotatably mounted to a jib/mizzen sail 404. In a similar manner, a second link 406 is rotatably mounted to the other end 407 of mainsail 401. The end of link 406 not mounted to mainsail 401 is rotatably mounted to a second jib/mizzen sail 408. This position is used for wind direction 405.

When it is necessary to tack, links 403 and 406 are each rotated about 200° into positions 409 and 410. This changes the aerodynamic performance of the sail assembly and allows the sail to act when the wind is blowing from apparent direction 410.

FIG. 5 is a front elevation view of a reefed sail assembly used in the invention. The mainsail is described here but similar construction applies to jib and mizzen. A tapered mast 501 is attached to the vessel (not shown). A plurality of sliding yards are slidably attached to mast 502–513. Yards 501–510 are organized into groups of three. Each group of three yards defines a panel of the sail. Each panel may be reefed individually. At each of the four reefing stations is a fixed yard 504, 507, 510 and 513. In each group, the fixed yard is the lower of the three shown. The second or middle yard at each station 503, 506, 509, 512, deploys to the intermediary position between the fixed yard. The third or upper yard of each panel 502, 505, 508 and 511 deploys to fit over the lower part of the next-above fixed yard. The uphaul and downhaul halyards are attached to the third yard, and this yard thus serves to lift the panel and the sailcloth to which it is secured to the deployed airfoil configuration.

FIG. 6 is a front elevation view of a single panel of FIG. 6. The two sliding yards 505 and 506 of the panel lower partway into a trough of yard 507 leaving room in the lower portion of fixed yard 507 and intermediary yard 506 to gather the furled sailcloth. Sufficient space is provided to drag the sailcloth into these cavities.

It will be apparent that the embodiment shown is only exemplary and that various modifications in construction and arrangement may be made without departing from the scope of the subjoined claims.

I claim:

1. A sail system for propelling a water vehicle comprising:

a two surface sail for converting wind energy into a force including a first surface having a positive curvature for producing an area of low pressure, and a second surface for producing an area of pressure higher than said area of low pressure, and means for separating said first surface from said second surface in such a manner that said sail is symmetrical along one axis; and, rotatable mast means for conveying said force to a water vehicle; and, yard means for attaching said sail to said mast means; and, boom means attached to said mast means for attachment of a second sail set to create a slot between 5 and 8 percent of the chord length of said first sail between said first sail and said second sail; and, a second two surface sail for converting wind energy into a force; and, a second rotatable mast attached to said boom means for rotating said second sail during tacking.

2. A sail system as in claim 1, further comprising:

a third two surface sail for converting wind energy into a force; and, a third rotatable mast for rotating said third sail during tacking; and, a second boom means attached to said first mast and said third mast for allowing rotation of said third mast relative to said first mast over the centerline of said vessel.

3. A sail system as in claim 2 wherein said first sail, said second sail, and said third sail are so configured by said first and said second boom means as to form a high lift low drag airfoil.

4. A sail system as in claim 3 wherein said first and second boom means are so arranged as to form two slots in the airfoil formed to prevent the airfoil from stalling while at high angles to the wind.

5. A sail system for a water craft comprising a mast mounted to the watercraft; and a first sail element rotatably mounted to said mast that includes a first surface and a second curved surface of greater curvature wherein said sail element is symmetrical to a plane normal to the first surface passing through said mast's centerline for converting wind energy into a force; and, a second mast; and, a first boom means rotatably mounted to said mast and rotatably mounted to said element second mast, and a second sail mounted to said second mast that includes a first surface and a second curved surface of greater curvature wherein said second sail element is symmetrical about a plane normal to said first sail surface of the second element passing through said second mast's centerline for converting wind energy into a force; and, a third mast; and, a second boom means attached to said first mast and said third mast for allowing rotation of said third mast relative to said first mast over the centerline of said vessel; and, a third sail element mounted to said third mast that includes a first surface and a second curved surface of greater curvature wherein said third sail element is symmetrical about a line normal to said first surface of the third sail element; and, wherein said first boom and said second boom and said second sail element and said third sail element are so aligned to form a single high lift low drag airfoil; and, wherein tacking is accomplished by rotating said first sail element about said mast 180 degrees and rotating said second sail element about said second mast 180 degrees and rotating said boom about the first mast over the centerline of the water craft an angle equal to but opposite from the angle said boom was to the centerline of the craft before tacking.

6. A sail system as in claim 5, wherein tacking is accomplished by rotating said first sail element about said mast 180 degrees and rotating said second sail element about said second mast 180 degrees and rotating said third sail element about said third mast about one half turn and rotating said boom about the first mast over the centerline of the water craft an angle equal to but opposite from the angle said boom was to the centerline of the water craft before tacking and rotating said second boom about said mast an angle equal to but opposite the angle said second boom was to the centerline of the craft before tacking.

* * * * *